US008590968B2

(12) United States Patent
Zahir

(10) Patent No.: US 8,590,968 B2
(45) Date of Patent: Nov. 26, 2013

(54) NURSING CHAIR

(76) Inventor: Kate Zahir, Victoria (CA)

( * ) Notice: Subject to any disclaimer, the term of this patent is extended or adjusted under 35 U.S.C. 154(b) by 418 days.

(21) Appl. No.: 12/942,984

(22) Filed: Nov. 9, 2010

(65) Prior Publication Data

US 2011/0109139 A1 May 12, 2011

Related U.S. Application Data

(60) Provisional application No. 61/259,954, filed on Nov. 10, 2009.

(51) Int. Cl.
*A47C 3/02* (2006.01)
*A47C 7/54* (2006.01)

(52) U.S. Cl.
USPC ..... 297/258.1; 297/261.1; 297/440.1; 297/440.14; 297/411.36

(58) Field of Classification Search
USPC ..... 297/258.1, 261.1, 440.14, 271.5, 271.6, 297/411.36, 261.4, 440.1
See application file for complete search history.

(56) References Cited

U.S. PATENT DOCUMENTS

| | | | | | |
|---|---|---|---|---|---|
| RE7,687 | E | * | 5/1877 | Morrison | 297/411.36 X |
| 3,526,429 | A | * | 9/1970 | Metzger | 297/271.5 |
| 4,534,591 | A | * | 8/1985 | Parker | 297/270.5 X |
| 8,197,003 | B2 | * | 6/2012 | Rogers | 297/258.1 |

* cited by examiner

*Primary Examiner* — Anthony D Barfield
(74) *Attorney, Agent, or Firm* — Gordon Thomson

(57) ABSTRACT

A nursing chair may be sold as a kit comprising a first side panel, a second side panel, a front panel between said first and second side panel, a front fabric cover, a back fabric cover, a first side armrest, a second side armrest, a seat between the first and second side panel, a back rest between the first and second side panels and a rocker assembly for supporting said chair and imparting a rocking motion to the chair. Suitable fastening means are included in the kit. The chair may be sold assembled.

3 Claims, 11 Drawing Sheets

NURSING CHAIR

RELATED APPLICATIONS

This application claims the benefit of U.S. Provisional Patent Application No. 61/259,954 filed in the United States Patent and Trademark Office on Nov. 10, 2009.

FEDERAL FUNDING

N/A

FIELD OF THE INVENTION

This invention relates to the field of chairs, and particularly to a rocker mounted chair, and specifically to a nursing chair for mothers.

BACKGROUND OF THE INVENTION

Nursing mothers are required to rest in a comfortable position while nursing a child. This is accomplished by the mother taking a seated position while holding the child in close proximity to her breast. Many chairs do not have a comfortable seating position for nursing mothers nor do they have arm rests suitable for nursing mothers. In particular, a chair having an adjustable arm rest for the mother is not available. Rocking chairs are often thought of as one of the more useful types of chairs for nursing mothers because the mother is able to impart a soothing motion to the child being nursed. This calms the child and makes him or her much easier to nurse. However, as far as the present applicant is concerned, there are no such rocker chairs combined with adjustable side rests for nursing mothers.

SUMMARY OF THE INVENTION

In order to overcome the deficiencies noted above my invention is a nursing chair comprising a first side panel, a second side panel, a front panel between the first and second side panel, a front fabric cover, a back fabric cover, a first side armrest, a second side armrest, a seat between the first and second side panel, a back rest between the first and second side panels and a rocker assembly for supporting the chair and imparting a rocking motion to the chair. The first side armrest further comprises a first side sliding track affixed to said first side panel for mounting the first side armrest, a first tensioning knob for securing the first side armrest in a desired location and a second tensioning knob for securing the first side armrest in the desired location. The second side armrest further comprises a second side sliding track affixed to the second side panel for mounting the second side armrest, a third tensioning knob for securing the second side armrest in a desired location and a fourth tensioning know for securing the second side armrest in the desired location. The rocker assembly comprises a first rocker support and a second rocker support. The chair further includes pillows for comfort. The chair can be sold as a kit comprising the following parts: a first side panel, a second side panel, a front panel between said first and second side panel, a front fabric cover, a back fabric cover, a first side armrest, a second side armrest, a seat between the first and second side panel, a back rest between the first and second side panels, a rocker assembly for supporting said chair and imparting a rocking motion to the chair, fastening means for fastening said parts.

DETAILED DESCRIPTION OF PREFERRED EMBODIMENTS OF THE INVENTION

Figure 1:
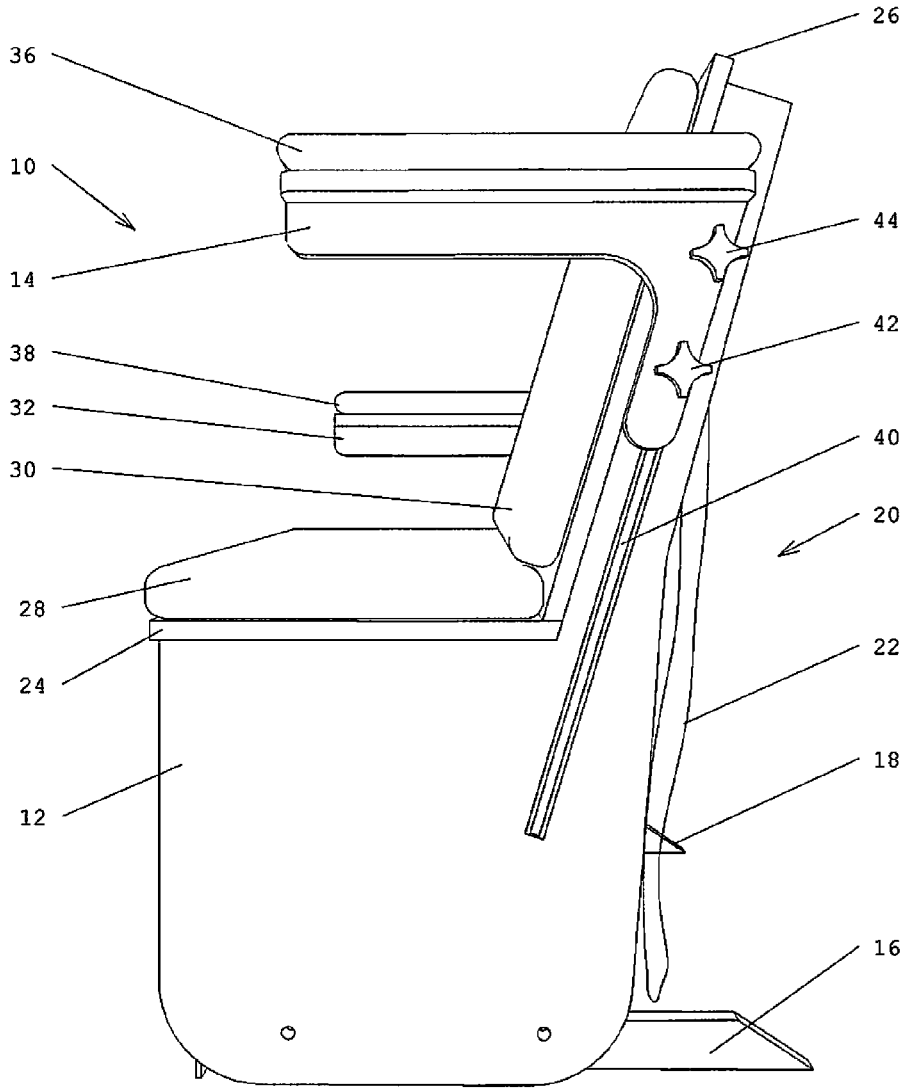
FIG. 1 is a side view of one embodiment of the invention.

Referring to FIG. 1, there is shown a side view of one embodiment of the invention 10 comprising a first side panel 12, a first adjustable side arm rest 14, a first side rocker base 16 and a second side rocker base 18. The chair also includes a back side 20 which in this embodiment is covered with a fabric material 22. The invention further comprises a seat 24 and a back rest 26 upon which pillows 28 and 30 are placed. Adjustable arm rests 14 and 32 also have pillows 36 and 38 placed upon them. The adjustable arm rest 14 slides up and down on track 40. The arm rest is secured in a desired position using tensioning knobs 42 and 44.

Figure 2:
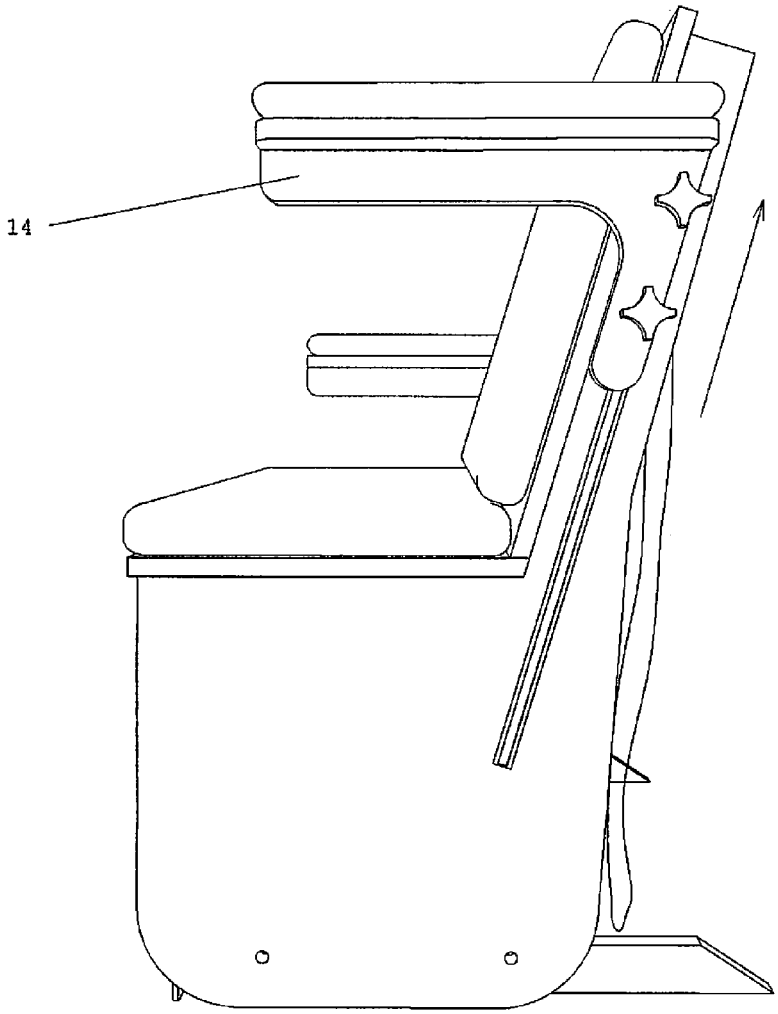
FIG. 2 is a side view of the invention showing one armrest in a top position.
Figure 3:
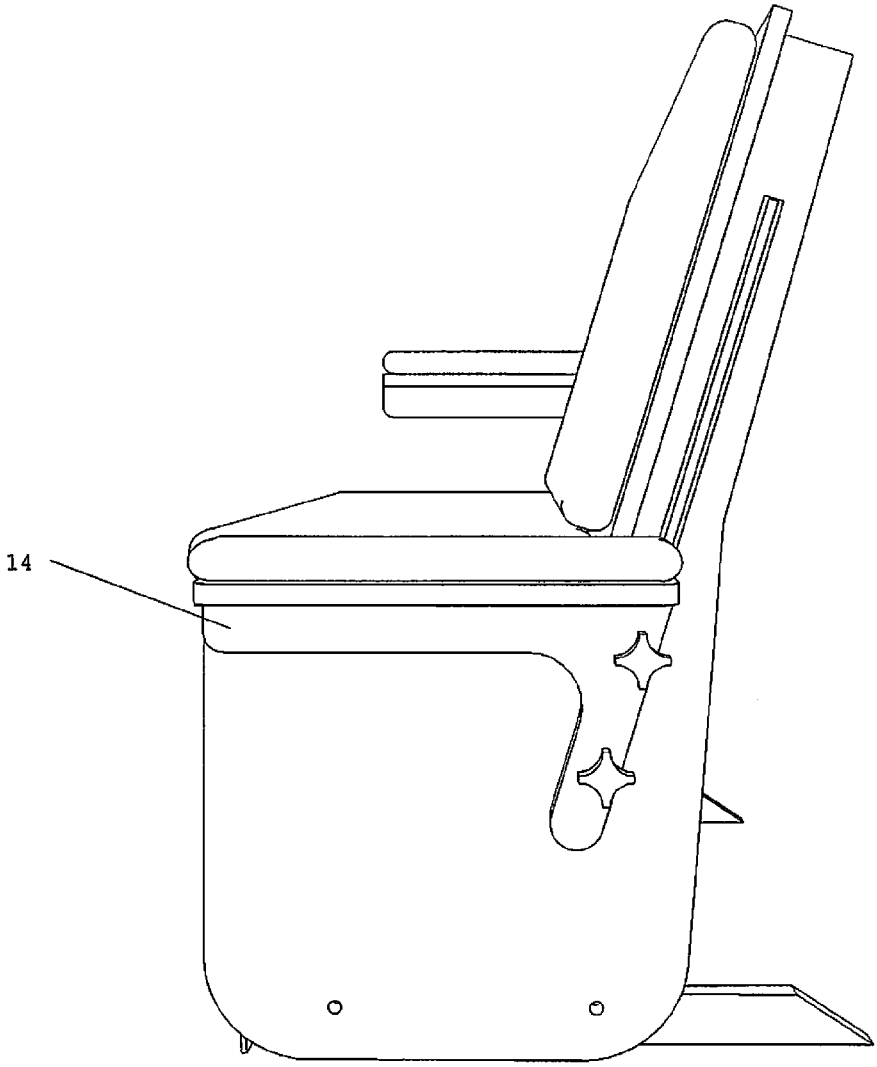
FIG. 3 is a side view of the invention showing one armrest in a bottom position.

Referring now to FIGS. 2 and 3, the armrest 14 is adjustable from a high position shown in FIG. 2 to a low position shown in FIG. 3. The armrest may be fixed in any position between these two points to suit the occupant.

Figure 4:
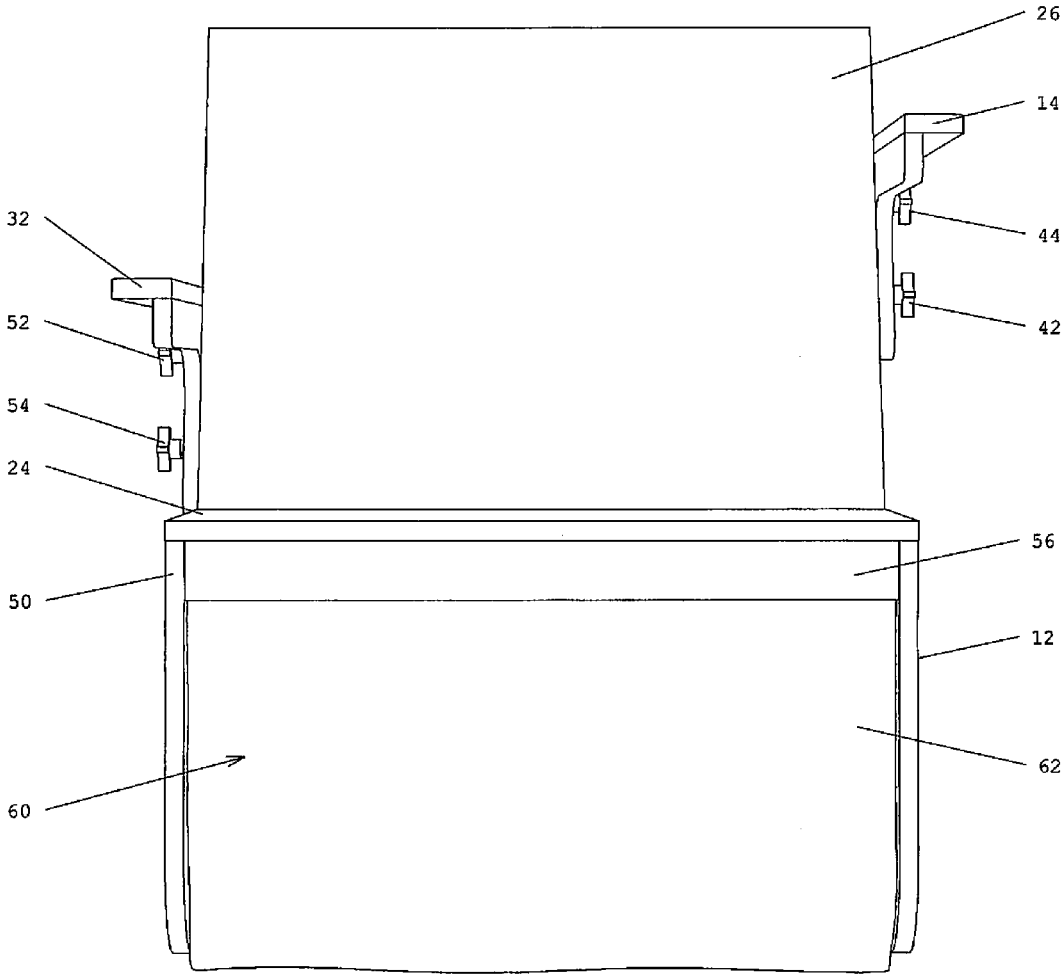
FIG. 4 is a front view of the invention.

Referring now to FIG. 4, there is shown a front view of the invention comprising a first side panel 12 and a second side panel 50, a first side adjustable arm rest 14 and a second side adjustable armrest 32, a seat 24 and a back 26. First side armrest 14 is secured to the chair by tensioning knobs 42 and 44. Second side armrest 32 is secured to the second side panel by tensioning knobs 52 and 54. Front panel 56 depends from the seat 24 and the front 60 of the chair is covered by a fabric material 62. The armrests 14 and 32 can be secured in any position for comfortable seating and nursing.

Figure 5:
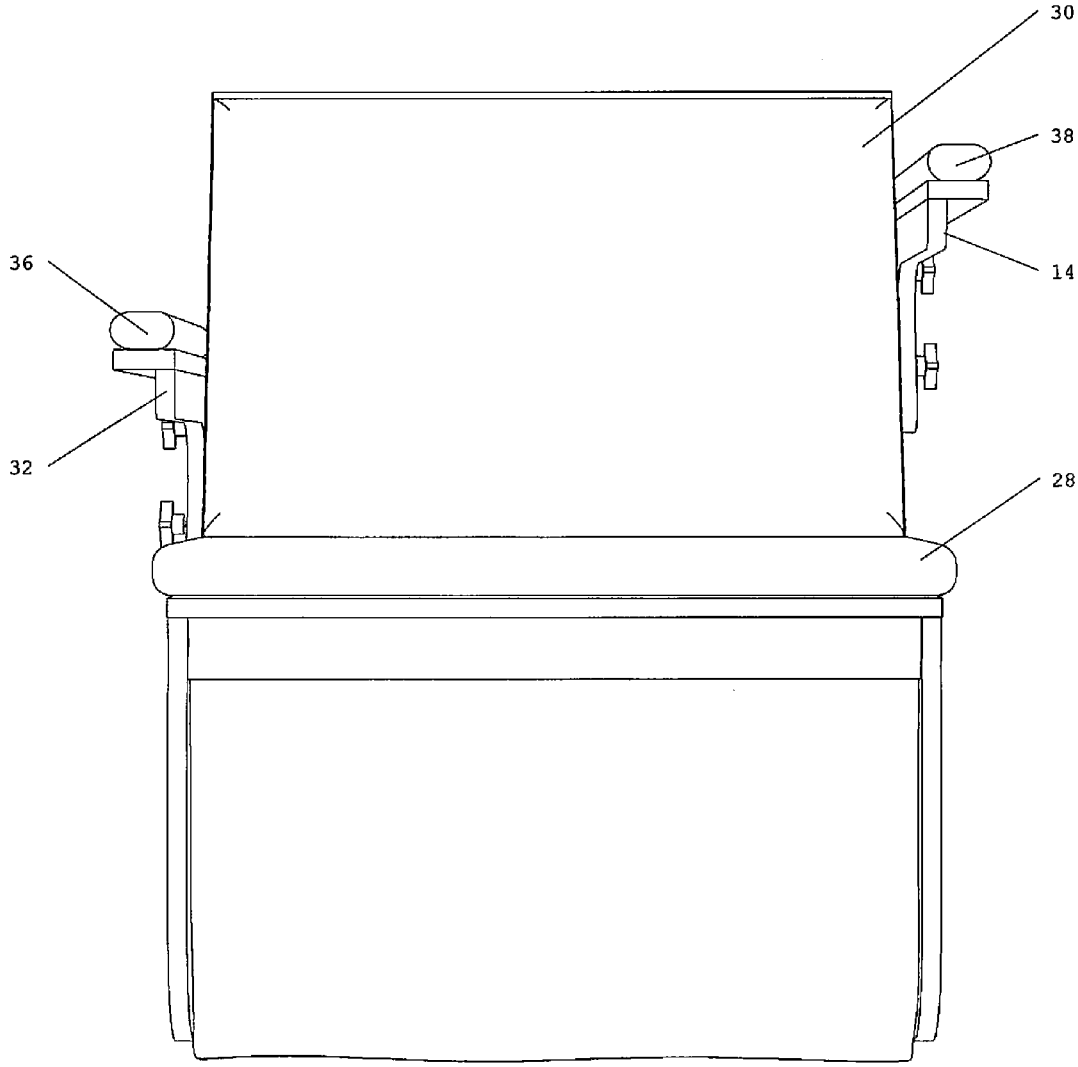
FIG. 5 is a front view of the invention with pillows.

Referring now to FIG. 5, there is shown a front view of the invention showing arms 14 and 32 in a mid-position and with pillows 28, 30, 36 and 38 placed on the chair for comfort of the occupant.

Figure 6:
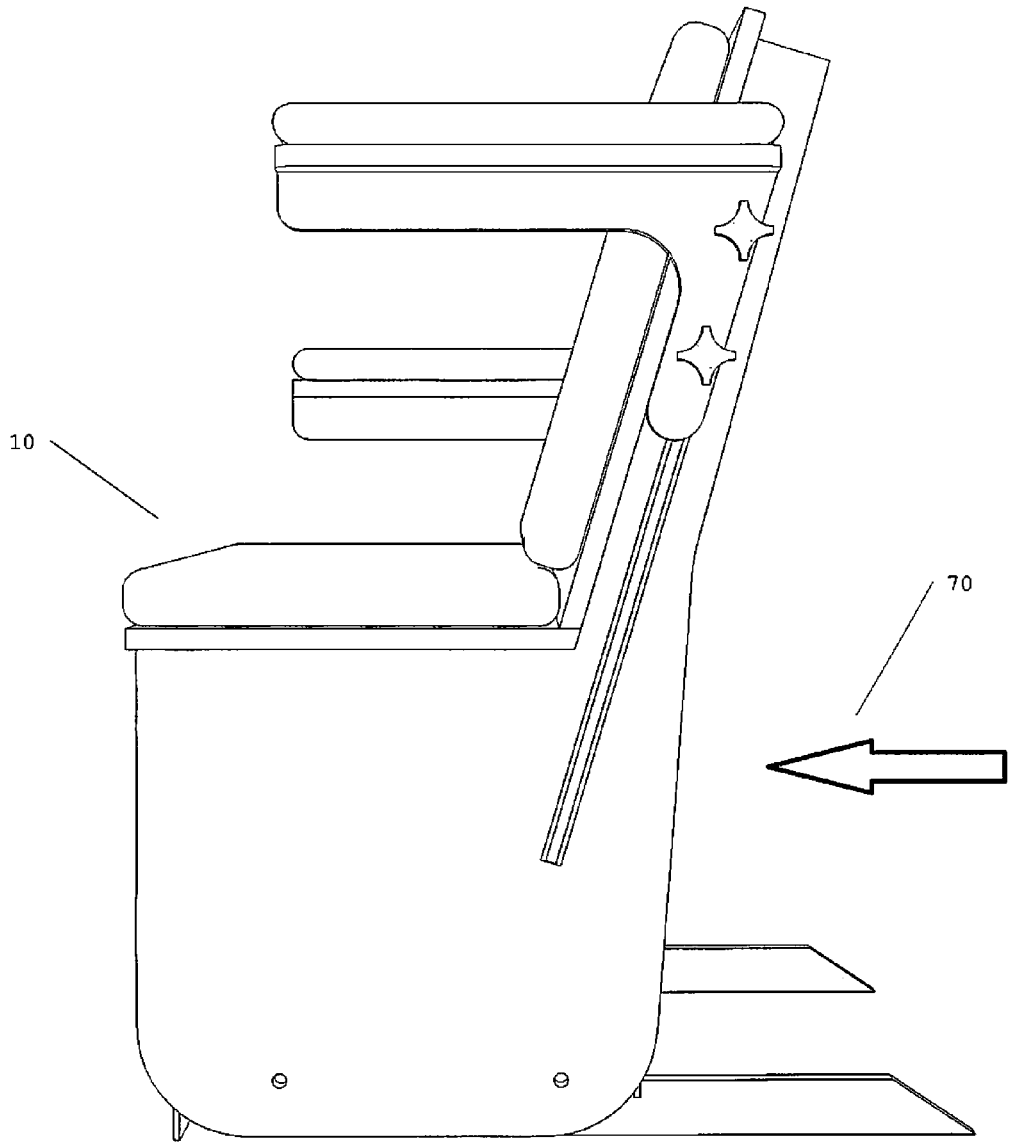
FIG. 6 is a side view of the invention in a forward position.

Referring now to FIG. 6, there is shown a side view of the invention 10 with arrow 70 denoting the fact that the invention is adjustable forward on its rocker.

Figure 7:
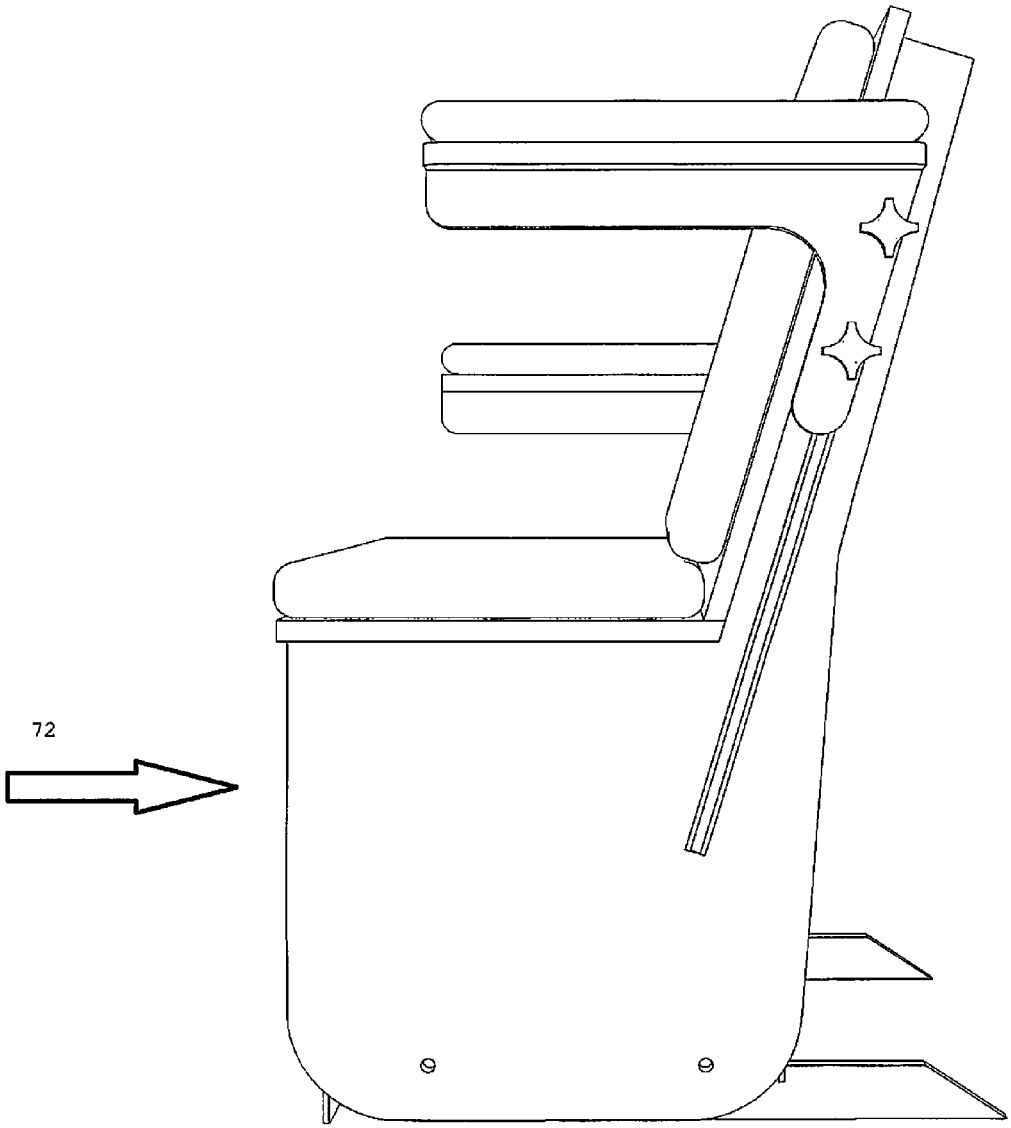
FIG. 7 is a side view of the invention in a rearward position.

Referring to FIG. 7, the invention is also adjustable backwards on its rocker.

In a preferred embodiment of the invention, the chair is assembled from a kit comprising two side panels, two tracks, four tensioning knobs, two arm rests, a front panel, a seat, a back, a rocker assembly and two fabric curtains. The pillows may be included with the kit or sold separately. The rocker assembly may be replaced with a static base.

Figure 8:
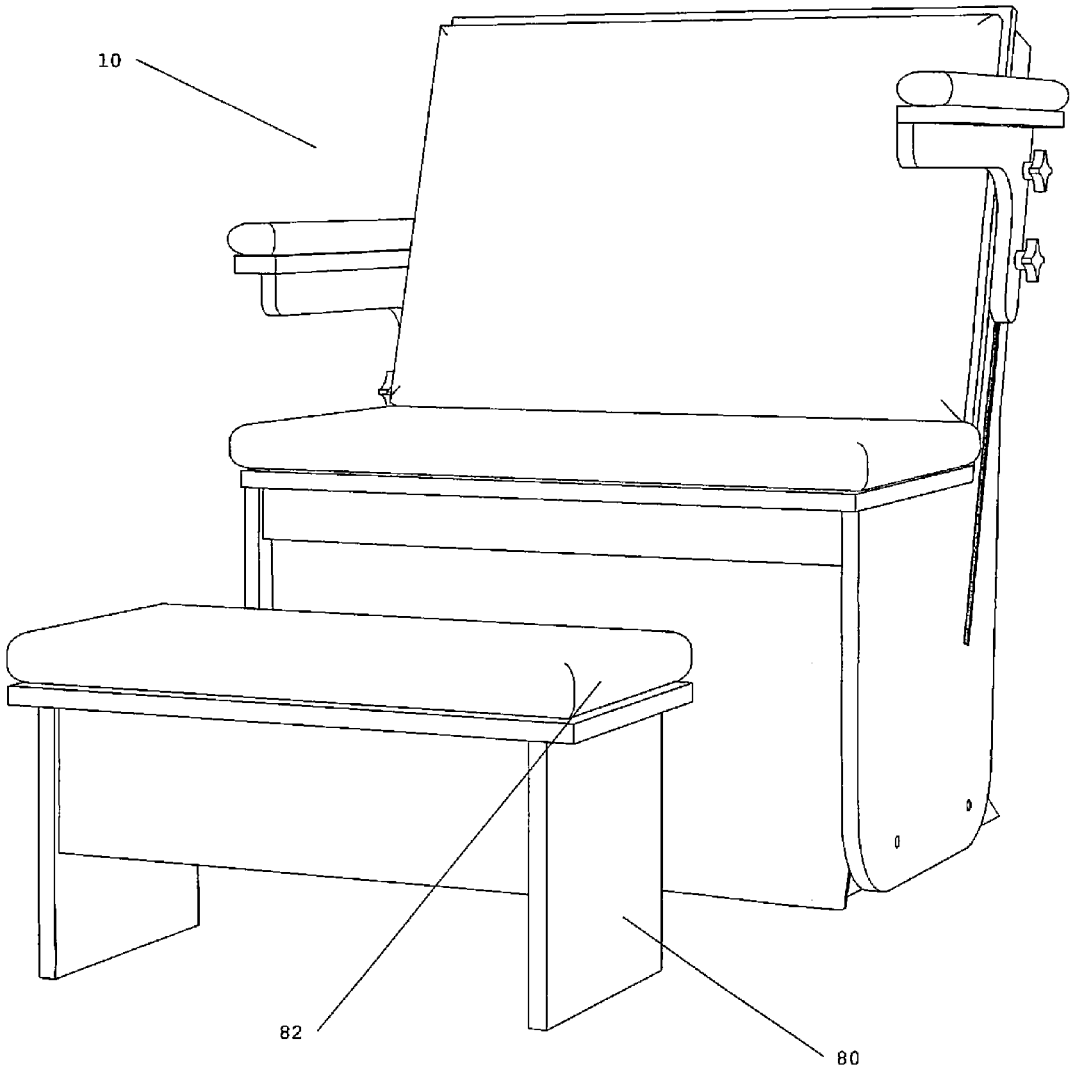
FIG. 8 is a view of the invention with an optional foot rest and pillow.

Referring to FIG. 8, there is shown one embodiment of the invention 10 with an optional foot rest 80 and pillow 82.

Figure 9:
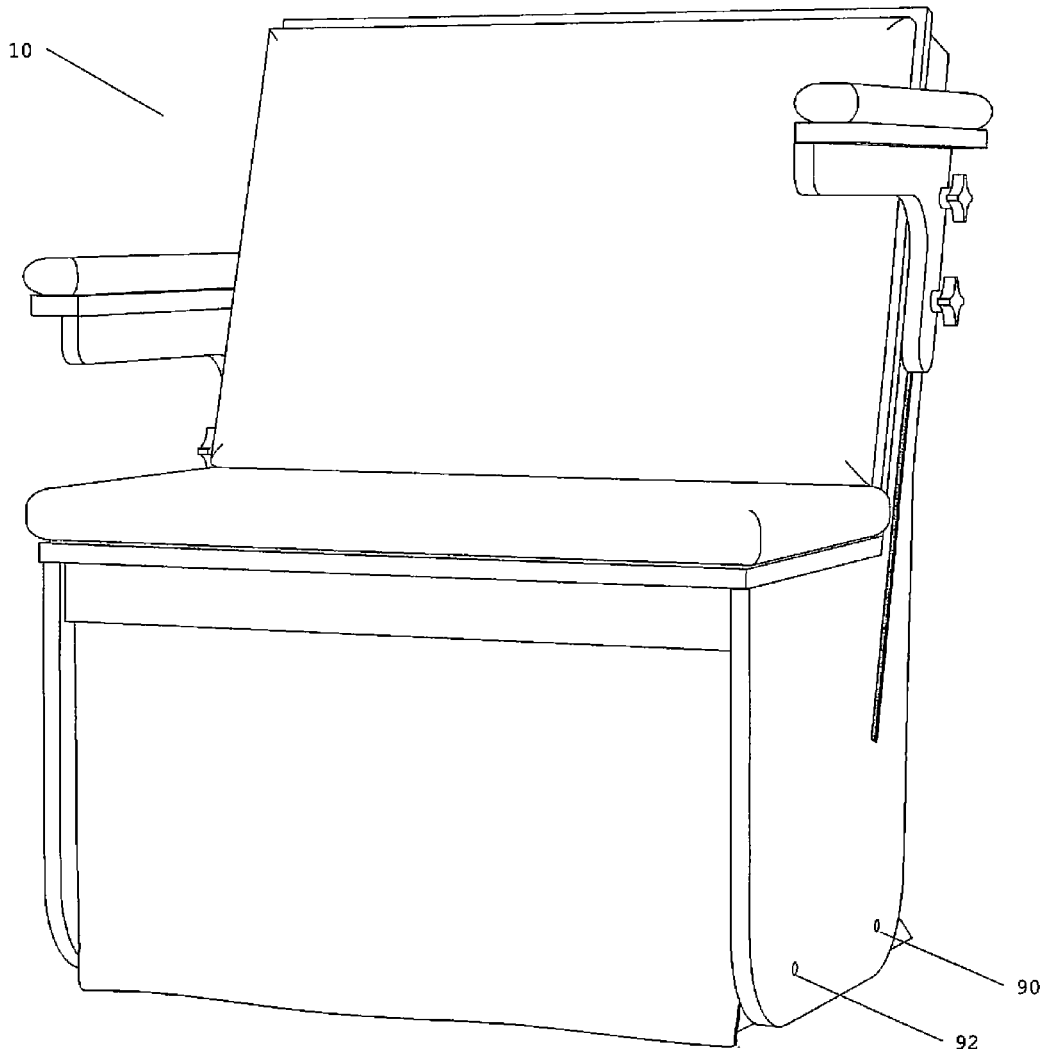
FIG. 9 is a front perspective view of the invention.

Referring to FIG. 9, there is shown a front perspective view of the invention 10. Fasteners 90 and 92 are shown.

Figure 10:
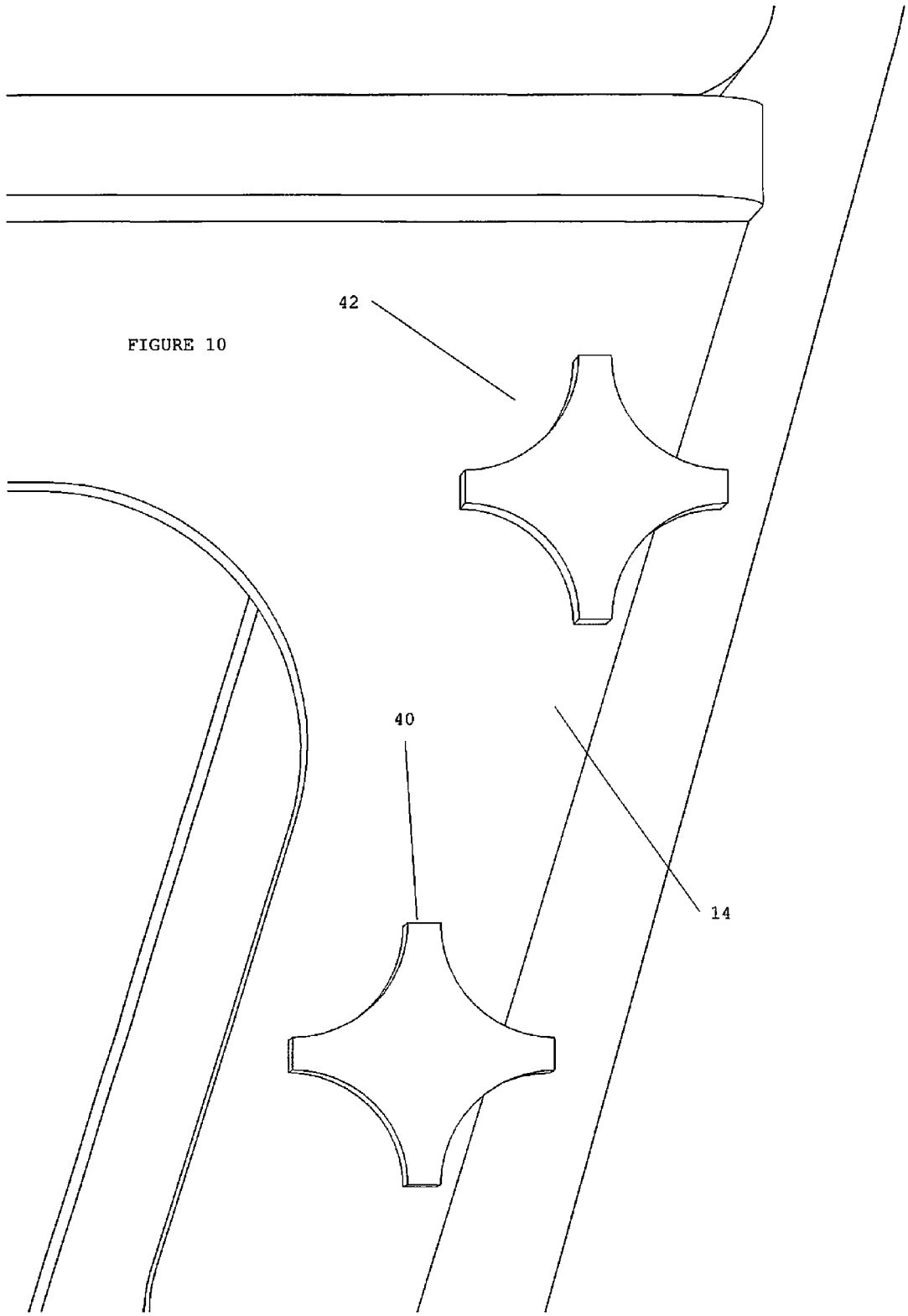
FIG. 10 is a close up view of the tensioning knobs of one embodiment of the invention.

Referring to FIG. 10, there is shown a close up view of the side arm rest 14 and the two tensioning knobs 40 and 42.

Figure 11:
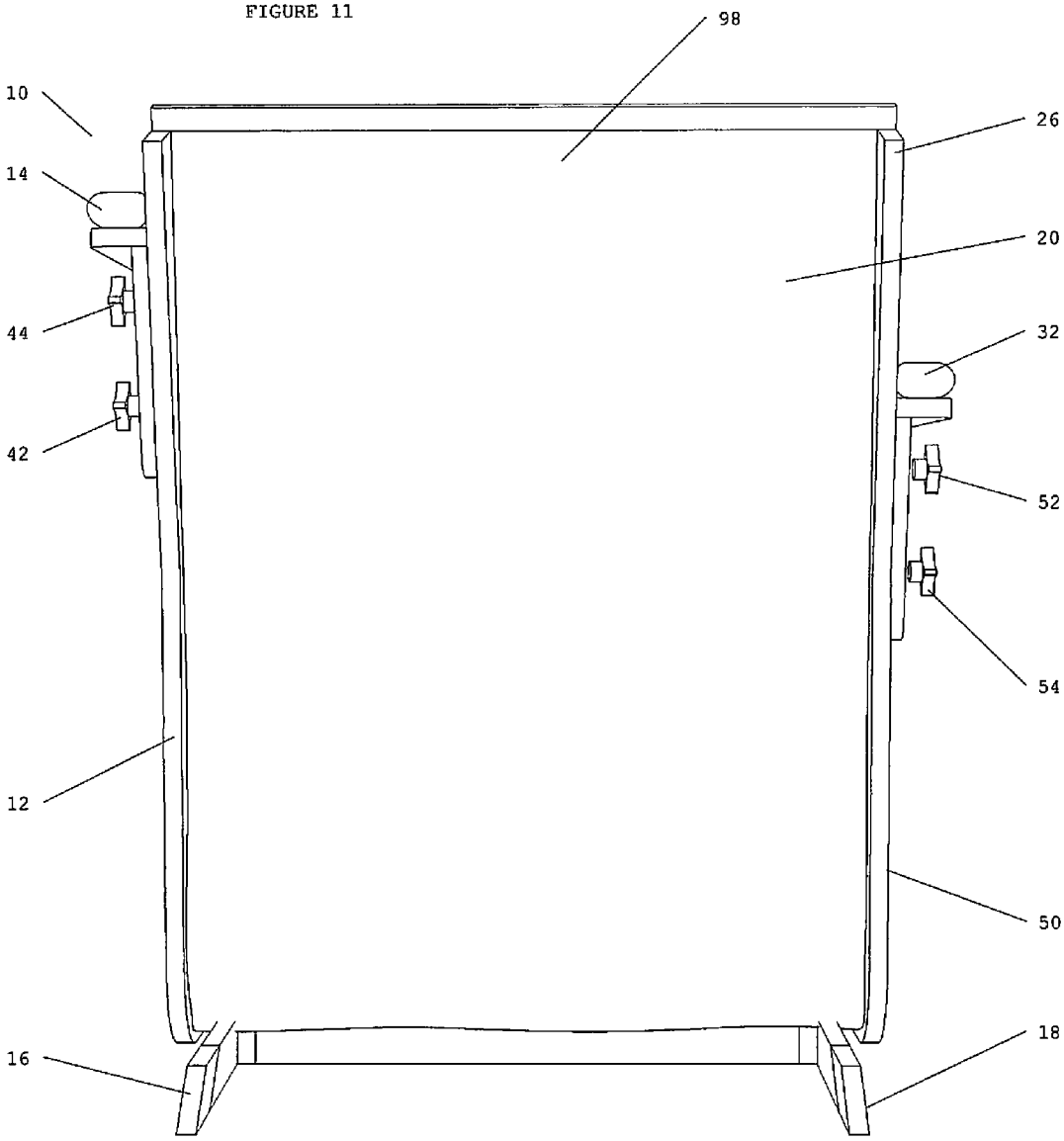
FIG. 11 is a view of the back side of the invention.

Referring to FIG. 11, there is shown a back view of the invention 10 comprising a first side panel 12 and a second side panel 50, a first rocker support 16 and a second rocker support 18, a first side armrest 14 and a second side armrest 32, first side tensioning knobs 40 and 42, second side tensioning knows 52 and 54, the top of back rest 26 and back side 20 covered in fabric 98.

I claim:

1. A nursing chair comprising a first side panel, a second side panel, a front panel for attachment between said first and second side panel, a front fabric cover, a back fabric cover, a first height adjustable side armrest mounted in a first sliding track to the first side panel, a second height adjustable side armrest mounted in second sliding track to the second side panel, a seat for attachment between the first and second side panels, a back rest for attachment between the first and second side panels and a rocker assembly for supporting said chair and imparting a rocking motion to the chair wherein the rocker assembly comprises a first side rocker base and a second side rocker base and wherein the chair is slidingly adjustable in a forwards and a backwards direction on the rocker assembly.

2. The nursing chair of claim 1 wherein the first height adjustable side armrest is moveably fixed to said first sliding track by a first and a second tensioning knob, and wherein the second height adjustable side armrest is moveably fixed to said second sliding track by a third and a fourth tensioning knob so that the first and the second height adjustable side armrests can be raised and lowered to a desired height and fixed at said desired height.

3. A kit for a nursing chair comprising the following parts: a first side panel, a second side panel, a front panel for attachment between said first and second side panels, a front fabric cover, a back fabric cover, a first height adjustable side armrest and sliding track assembly for mounting said first height adjustable side armrest to first side panel, a second height adjustable side armrest and sliding track assembly for mounting said second height adjustable side armrest to the second side panel, a seat for attachment between the first and second side panels, a back rest for attachment between the first and second side panels, a rocker assembly for supporting said chair and imparting a rocking motion to the chair, fastening means for fastening said parts, wherein said rocker assembly comprises a first side rocker base and a second side rocker base and wherein, once assembled, the nursing chair is slidingly adjustable in a forwards and a backwards direction on the rocker base.

* * * * *